US007172026B2

(12) United States Patent
Misselbrook

(10) Patent No.: US 7,172,026 B2
(45) Date of Patent: Feb. 6, 2007

(54) APPARATUS TO ALLOW A COILED TUBING TRACTOR TO TRAVERSE A HORIZONTAL WELLBORE

(75) Inventor: John G Misselbrook, Houston, TX (US)

(73) Assignee: BJ Services Company, Houston, TX (US)

( * ) Notice: Subject to any disclaimer, the term of this patent is extended or adjusted under 35 U.S.C. 154(b) by 163 days.

(21) Appl. No.: 10/816,287

(22) Filed: Apr. 1, 2004

(65) Prior Publication Data

US 2005/0217861 A1 Oct. 6, 2005

(51) Int. Cl.
*E21B 37/00* (2006.01)

(52) U.S. Cl. ..... 166/381; 166/173; 166/222; 166/373

(58) Field of Classification Search ..... None
See application file for complete search history.

(56) References Cited

U.S. PATENT DOCUMENTS

| | | | | |
|---|---|---|---|---|
| 5,565,633 | A | 10/1996 | Wernicke | 73/865.8 |
| 6,003,606 | A | 12/1999 | Moore et al. | 166/381 |
| 6,230,813 | B1 | 5/2001 | Moore et al. | 166/381 |
| 6,241,031 | B1 | 6/2001 | Beaufort et al. | 175/99 |
| 6,286,592 | B1 | 9/2001 | Moore et al. | 166/50 |
| 6,296,066 | B1 * | 10/2001 | Terry et al. | 175/92 |
| 6,347,674 | B1 | 2/2002 | Bloom et al. | 175/51 |
| 6,427,786 | B2 | 8/2002 | Beaufort et al. | 175/99 |
| 6,478,097 | B2 | 11/2002 | Bloom et al. | 175/51 |
| 6,601,652 | B1 | 8/2003 | Moore et al. | 166/381 |
| 6,607,607 | B2 | 8/2003 | Walker et al. | 134/18 |
| 6,679,341 | B2 | 1/2004 | Bloom et al. | 175/51 |

FOREIGN PATENT DOCUMENTS

| | | |
|---|---|---|
| WO | WO 03/067016 | 8/2003 |

OTHER PUBLICATIONS

Welltec brochure "The Well Tractor® Company" undated.
BJ Service Company Product Sales Bulletin entitled "Tornado ™ Nozzle" (Apr. 27, 2001).
BJ Services Company Product Sales Bulletin entitled "Roto-Jet® Rotary Jetting Tool" (Apr. 11, 2002).
Wester Well Tool brochure for "All-Hydraulic Intervention Tractor™" (2003).
Search Report under Section 17 concerning UK patent app. GB0506422.5, May 13, 2005.
Jun. 22, 2006 British Search Report under Section 18(3) concerning GB Patent App. GB0506422.5.

* cited by examiner

*Primary Examiner*—Zakiya W. Bates
(74) *Attorney, Agent, or Firm*—Howrey LLP

(57) ABSTRACT

Apparatus and methods for removing sand and/or other fill material located in a wellbore ahead of a coiled tubing tractor and displacing the material behind the tractor. More particularly, the apparatus and methods allow a coiled tubing tractor to drive forward in a wellbore by removing fill material in front of the tractor thereby allowing the wheels or traction pads of the tractor to remain in contact with the wellbore.

42 Claims, 5 Drawing Sheets

12
15
42
46
40
44
20

APPARATUS TO ALLOW A COILED TUBING TRACTOR TO TRAVERSE A HORIZONTAL WELLBORE

BACKGROUND OF THE INVENTION

1. Field of the Invention

The present invention is directed to apparatus and methods for removing sand and/or other fill material located in a wellbore ahead of a coiled tubing tractor and displacing the material behind the tractor. More particularly, the apparatus and methods of the present invention allow a coiled tubing tractor to drive forward in a wellbore by the removal of fill material in front of the tractor thereby allowing the wheels or traction pads of the tractor to remain in contact with the wellbore.

2. Description of the Related Art

Operators are drilling an increasing number of long reach horizontal wells to better access remote reserves of oil and/or gas. Many of these "extended reach" wells have passed the limit where unaided re-entry to the bottom of the wellbore is possible with practical sizes of coiled tubing. The industry has responded by developing hydraulically powered tractors that can be attached to the bottom of the coiled tubing for the purpose of pulling the coiled tubing along the horizontal section of the well. This technology is relatively new with only a few coiled tubing tractor jobs having been attempted to date but there is concern that the reliability of the technology could be seriously compromised by significant quantities of sand or fill on the low side of the hole. The unanswered question is how reliably can the different tractor types perform when they are trying to drive their wheels or traction pads through a substantial sand bed. Sand beds on the low side of the wellbore represent a potentially significant obstacle. For example, a 3 inch deep sand bed in a 6¼ inch hole could cause a tractor to begin pushing the sand ahead of it until a point is reached where the tool becomes stuck in the wellbore. Thus, there is a need for a way to clear the wellbore of sand or fill in the immediate vicinity ahead of the tractor so the tractor does not have to attempt to negotiate through and/or over such an obstacle. Although sand typically is the most prevalent wellbore fill material, it shall be understood that use of the term "sand" hereinafter shall also include any other wellbore particulates such as drill cuttings, metal shavings and wellbore fines.

SUMMARY OF THE INVENTION

The present invention employs a series of forward and rearward angled jetting assemblies that can be attached to or configured within the coiled tubing tractor itself. The leading assembly has forward angled nozzles to fluidize the sand bed ahead of the tractor plus a series of rearward angled nozzles that maintain the sand in turbulent suspension for a sufficient distance to ensure that the sand settles behind the tractor. The objective is to remove sand from the specific area in the well where the tractor is situated and allow it to deposit behind the tractor. The tractor itself would thus be operating in a portion of the wellbore that is largely unobstructed by any sand bed. Depending on the tractor length it may be necessary to include several rearward jet nozzles at strategic intervals along the tractor length to ensure that sand is carried the required distance. The addition of polymers in the circulating fluid may aid in the temporary suspension of sand and thus reduce the requirement for multiple rearward nozzle assemblies.

An alternative embodiment uses a jet pump to suck in the fluidized sand and vigorously expel the sand in the rearward direction. The fluidized sand discharge would either be directly into the annulus around the tractor or preferably through a separate return fluid passageway running substantially the full length of the tractor. Preferably this return fluid passageway is engineered within the tractor itself but, if wellbore and tractor dimensions permitted, it may be attached to the outside of the tractor.

The tractor would in effect "burrow" along the well while pulling the coiled tubing behind it. Any in-line, pump-through tool having rearward facing jetting nozzles, such as the Tornado™ tool offered by BJ Services Company, could be run behind the tractor without compromising the washing action around the tractor. When the drag of the sand on the coiled tubing reached the pull limit of the tractor, a wiper trip would be initiated and the sand beds behind the tractor could be swept out of the hole by the rearward facing nozzles of the pump-through tool after which forward progress along the wellbore could be re-initiated.

One embodiment of the present invention is directed to a wellbore tractor comprising a tractor body, a central fluid passageway extending through the length of the tractor body, a return fluid passageway and a means for driving the tractor through the wellbore. The return fluid flow passageway further comprises one or more flow conduits that may extend longitudinally through at least a portion of the wall of the tractor body. Alternatively, the one or more flow conduits may comprise one or more external flow channels extending along at least a portion of the outer surface of the tractor body. Preferably, the external flow channels are attached between the means for driving the tractor.

In an alternative embodiment of the invention, a wellbore tractor is provided having a tractor body, a central fluid passageway extending through the length of the tractor body, one or more rearward facing jet nozzles extending through the tractor body and in fluid communication with the central fluid passageway, and a means for driving a tractor through the wellbore.

A method of moving a coiled tubing tractor through a wellbore is also provided comprising the steps of running a coiled tubing tractor assembly on a coiled tubing into the wellbore, wherein the tractor assembly comprises one or more forward facing nozzles, a jet pump and the tractor. The method further comprises removing one or more sand beds ahead of the tractor by fluidizing the sand particles with the one or more forward facing jet nozzles to create a sand-ladened slurry, pumping the sand-ladened slurry via the jet pump past the trailing end of the tractor and driving the tractor through a portion of the wellbore that previously contained one or more sand beds. The method further comprises circulating and/or sweeping the sand out of the wellbore, preferably while pulling out of the hole with the coiled tubing tractor assembly with one or more rearward facing nozzles located between the tractor and the coiled tubing.

Another method of moving the coiled tubing tractor to the wellbore comprises the steps of running a coiled tubing tractor assembly on a coiled tubing into the wellbore, the tractor assembly comprising one or more forward facing jet nozzles, the tractor and one or more rearward facing jet nozzles. The method further comprises the steps of removing one or more sand beds ahead of the tractor by fluidizing the sand particles with the one or more forward facing jet nozzles, maintaining the sand in fluid suspension with the rearward facing jet nozzles until the sand particles settle behind the tractor and driving the tractor through the portion of the wellbore that previously contained the one or more sand beds.

Another embodiment of the invention is directed to a coiled tubing tractor assembly comprising a forward jetting assembly operable to fluidize sand beds ahead of the coiled tubing tractor, the coiled tubing tractor having a tractor body, a central fluid passageway and a return fluid passageway. The assembly also comprises a jet pump connected between the forward jetting assembly and the tractor, wherein the jet pump is operable to pump the fluidized sand through the return fluid passageway to expel the fluidized sand past the trailing end of the tractor. The assembly may further comprise a rearward facing jetting tool operable to circulate or sweep the sand behind the tractor out of the wellbore. The assembly may comprise a fluid manifold in fluid communication with the return fluid passageway.

An alternative assembly comprises a forward jetting assembly operable to fluidize sand beds ahead of a coiled tubing tractor, the coiled tubing tractor having a tractor body, a central fluid passageway extending through the tractor body, and one or more rearward facing jet nozzles extending through the tractor body and in fluid communication with the central fluid passageway wherein the rearward facing nozzles are operable to maintain the sand in fluid suspension until the sand travels past the tractor.

The present invention could also be used to move a coiled tubing tractor through a flowline, such as a water or petroleum pipeline, that contains particulate matter. The particulate matter in the flowline would be moved from in front of the tractor and displaced to a position behind the tractor in a similar manner as described in a wellbore.

BRIEF DESCRIPTION OF THE DRAWINGS

The following figures form part of the present specification and are included to further demonstrate certain aspects of the present invention. The invention may be better understood by reference to one or more of these figures in combination with the detailed description of specific embodiments presented herein.

DETAILED DESCRIPTION OF THE INVENTION

Figure 1:
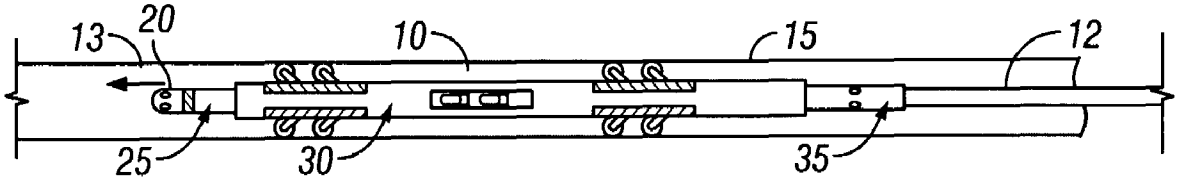
FIG. 1 illustrates one embodiment of a coiled tubing tractor assembly in a horizontal wellbore.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

Figure 2:
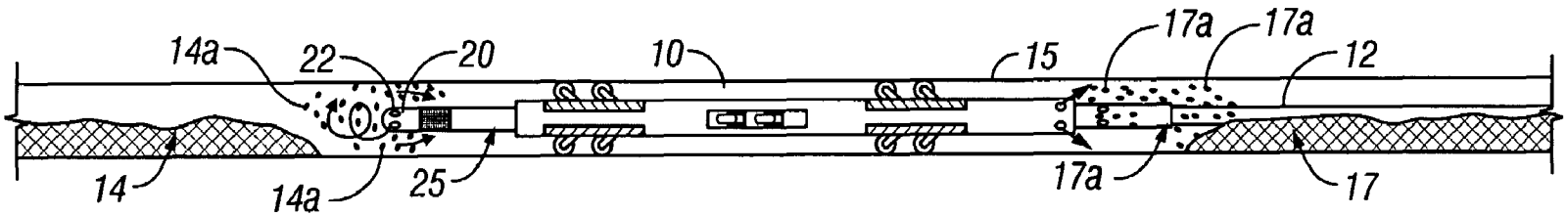
FIG. 2 illustrates a coiled tubing tractor assembly according to one embodiment of the present invention being moved through a horizontal wellbore having sand beds on the low side of the wellbore.

FIGS. 1 and 2 illustrate one embodiment of the present invention. A wellbore tractor assembly 10 is illustrated driving a coiled tubing string 12 through a horizontal section of wellbore 15 in the direction indicated by arrow 13. Coiled tubing tractor assembly 10 in FIG. 1 comprises a forward facing jetting assembly 20, jet pump 25, coiled tubing tractor 30, and a rearward angled jetting assembly 35. In a preferred embodiment, forward facing jetting assembly 20 comprises one or more angled, stationary jet nozzles that create a swirling flow ahead of the nozzles when fluid is pumped down through the tractor assembly and out the nozzles. The angled stationary jet nozzles produce a tangential effect for the exiting jet stream. The swirling fluid flow disturbs the sand beds 14 located ahead of the tractor assembly and fluidizes the particles contained therein. Alternatively, forward facing jetting assembly 20 may comprise a rotating jetting head. An example of a rotating jetting head is the Rotojet™, commercially available from BJ Services Company.

Figure 3:
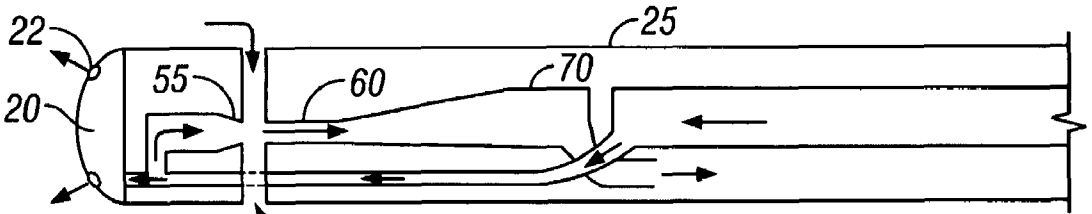
FIG. 3 illustrates a cross section of a conventional jet pump connected to a forward jetting assembly.

FIG. 3 illustrates a conventional jet pump suitable for working with the assembly illustrated in FIGS. 1 and 2. A conventional jet pump is a hydraulic pump with no moving parts. A power fluid is pumped down a central passageway 50 wherein a portion of the power fluid will exit the front of the pump, in this case through one or more forward facing jet nozzles 22 of jetting assembly 20 to fluidize the sand ahead of the tractor assembly. The remaining portion of the power fluid is forced through a venturi jet nozzle 55 and into throat 60 of the jet pump. By way of example, ¼ of the power fluid may exit the pump to fluidize the sand and ¾ of the power fluid may be pumped through the venturi jet nozzle as illustrated by the arrows of FIG. 3. The flow of fluid through the venturi jet nozzle and into the throat creates a suction pressure that sucks the fluidized sand into side inlet ports 65. The fluidized sand combines with the power fluid and enters into throat 60 of the jet pump. The power fluid and sand picked up by the jet pump continue through the diffuser 70 of jet pump 25 and the sand-ladened slurry is pumped out of the trailing end of the jet pump. Typically, jet pumps are used to pump the sand-ladened slurry completely out of the wellbore. However, traditional uses of the jet pump have depth and/or pressure limitations. With the present invention, the jet pump is only used to pump the slurry past the tractor.

It is difficult to pick up solids from a sand bed at the bottom of a wellbore with a conventional jet pump alone. It is better to fluidize the sand particles of the sand bed such that the sand particles are suspended in the liquid. The sand slurry is then sucked into the jet pump and pumped up the wellbore. Accordingly, a preferred embodiment of the present invention utilizes a jet pump connect to and in fluid communication with a forward facing jetting assembly. The jet stream from nozzles 22 stir up the sand, fluidize the particles 14*a* and then the jet pump sucks the fluidized material into the fluid intake of the pump and pumps the slurry up the wellbore and past the tractor. The power fluid can be water, drilling mud or any other suitable liquid. The power fluid may include polymers to aid in temporarily suspending the sand particles as the sand is transported from an area ahead of the tractor to an area behind the tractor. The transported sand 17*a* may form new sand beds 17 behind the tractor assembly.

Figure 4:
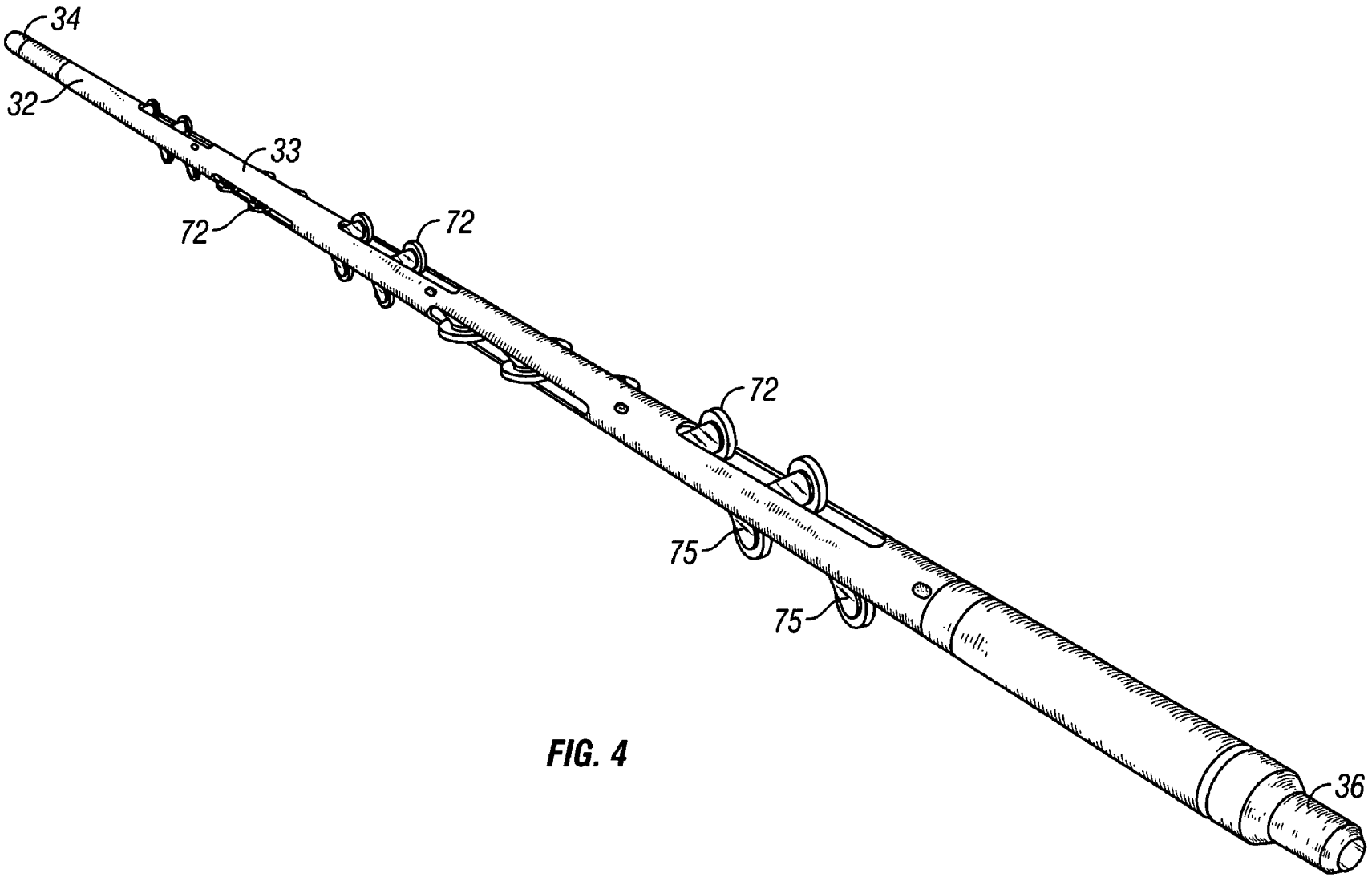
FIG. 4 is an illustration of a prior art coiled tubing tractor.

Tractor 30 is connected to jet pump 25 in the tractor assembly illustrated in FIGS. 1 and 2. A coiled tubing tractor, such as the Well Tractor® from Weltec (as illustrated in FIG. 4), utilizes a fluid driven turbine 32 to drive the internal hydraulic system 33. The hydraulic system of the Well Tractor® consists of two pressurized systems. The first system will force a plurality of wheel arms 75 out from the tractor body so that the wheels 72 of the tractor will contact the casing or borehole wall. The second system provides the driving force for driving the tractor through the wellbore. Coiled tubing tractors are attached to coiled tubing and are activated when it is no longer possible to run the coiled tubing string into the wellbore with the coiled tubing injector. The tractor is activated by pumping fluid through the tubing, into the tractor body and through the turbine. The tractor will drive the coiled tubing into the wellbore as long as the flow rate of the fluid through the tractor is maintained above a predetermined rate. Once the pumping of the wellbore fluid falls below the predetermined rate, the wheels 72 will retract back into the body of the tractor. Preferably, once the tractor is deactivated, the wheels will retract into the body to leave a flush outside diameter. Tractor 30 includes top connector 34 and bottom connector 36.

Figures 5A, 5B, 5C, 5D, 5E, 5F, 5G:
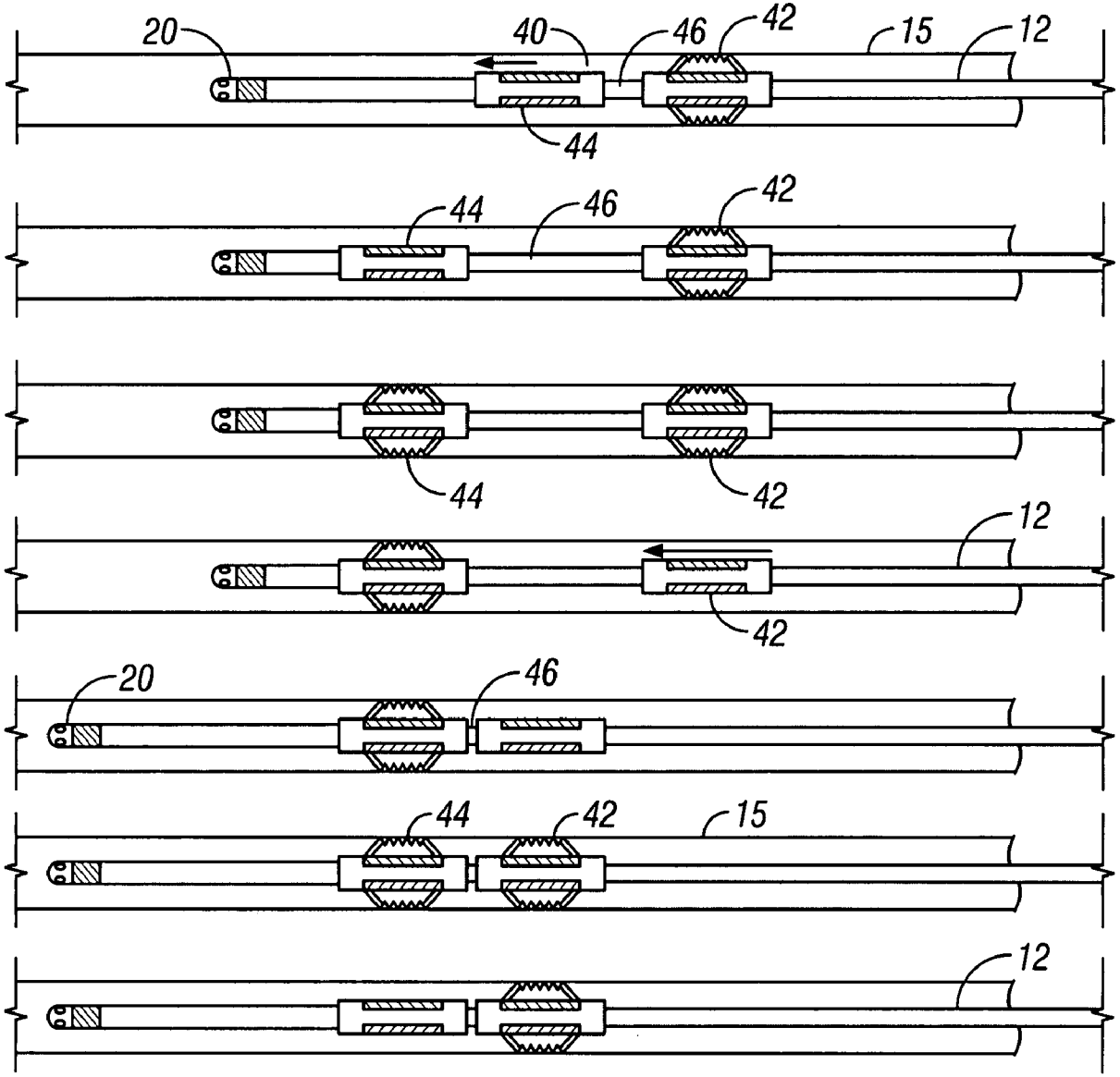
FIGS. 5A–G illustrate a caterpillar-type down hole tractor moving through a horizontal section of a wellbore.

In an alternative embodiment, the coiled tubing tractor includes a pair of hydraulic grippers and a telescopic hydraulic cylinder as the means for driving the tractor, and the coiled tubing it is pulling, into a wellbore. The All-Hydraulic Intervention Tractor™, offered by Western Well Tool, Inc., is a commercial example of the caterpillar-type wellbore tractor. Other examples of caterpillar-type tractors are disclosed in U.S. Pat. Nos. 6,003,606, 6,286,592, 6,230,813, 6,601,652, 6,241,031, 6,427,786, 6,347,674, 6,478,097 and 6,679,341, all of which are incorporated herein by reference. FIGS. 5A–G illustrate how the caterpillar-type downhole tractor 40 works. In FIG. 5A, rear gripping mechanism 42 is activated, the front gripping mechanism 44 is retracted, and the telescopic cylinder 46 is in the retracted position. FIG. 5B illustrates the tractor when the rear gripping mechanism is activated, the front gripping mechanism is retracted, and the telescopic cylinder is at full extension. Next, both the front and rear gripping mechanisms are activated while the telescopic cylinder is fully extended. In FIG. 5D, the rear gripping mechanism is retracted and the telescopic cylinder is retracting while the front gripping mechanism is activated. Once the telescopic cylinder is fully retracted, as shown in FIG. 5E, the rear gripping mechanism is activated into gripping engagement with the wellbore (FIG. 5F). Once the rear gripping mechanism is activated, the front gripping mechanism is retracted and the telescopic cylinder is ready to be extended as illustrated in FIG. 5G. The steps illustrated in FIGS. 5A–G are then repeated to move the tractor and coiled tubing down the wellbore. The tractor has a central passageway extending longitudinally through the hydraulic cylinder of the tractor for receiving the power fluid. The central passageway is in fluid communication with the hydraulic system used to operate the tractor.

Figure 6:
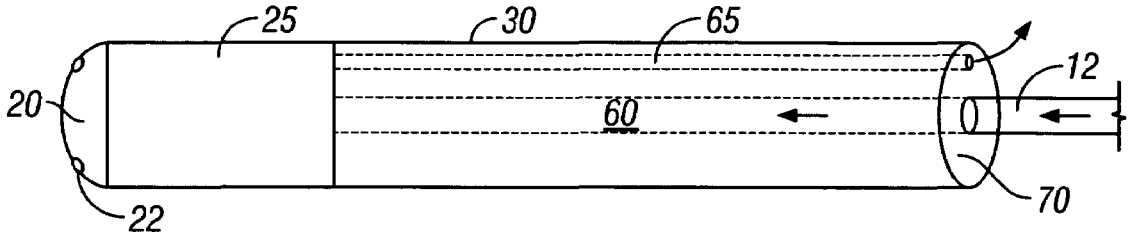
FIG. 6 is a side view of an improved wellbore tractor according to one embodiment of the present invention.

In a preferred embodiment, tractor 30, shown in FIG. 6, includes a tractor body 70, a central fluid passageway 60 extending through the length of the tractor body, and a means for driving the tractor through the wellbore (not shown). The means for driving the tractor may be selected from any of the previously described prior art means such as the plurality of hydraulically actuated extendable wheels, spaced about the circumference of the tractor as illustrated in FIG. 4, or the pair of hydraulically activated gripping mechanisms and telescopic cylinder used in the caterpillar-type tractor illustrated in FIGS. 5A–G, or any other equivalent structure. As indicated above, such means for driving a tractor are known in the art.

Figure 7:
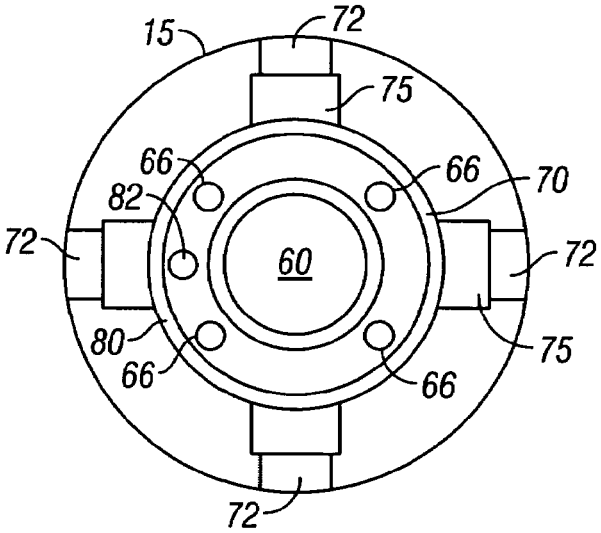
FIG. 7 is an end view of an improved, wheeled wellbore tractor having a plurality of flow conduits extending longitudinally through the wall of the tractor body.

Unlike the prior art tractors, tractor 30 also includes a novel return fluid passageway 65. The return fluid passageway 65 is in fluid communication with the discharge of jet pump 25. Thus, the sand-ladened slurry is pumped from jet pump 25 into the return fluid passageway 65 of tractor 30. The return fluid passageway may comprise one or more flow conduits. In one embodiment, the one or more flow conduits extend longitudinally through at least a portion of the wall of the tractor body, wherein the wall of the tractor body is defined as the area between the central passageway and the outer surface of the tractor body. FIG. 7 illustrates one embodiment that includes four flow conduits 66 that extend longitudinally through wall 70. Flow conduits 66 are equally spaced around the tractor body and extend through the wall of the tractor body between the wheel wells for extendable wheels 72 and arms 75.

Alternatively, the one or more fluid flow conduits may comprise one or more external flow channels 85 extending along at least a portion of the outer surface of the tractor body. Preferably, the one or more flow conduits extend substantially the entire length of the wellbore tractor so that the fluidized fill may be pumped by the jet pump through the tractor and exhausted or expelled behind the wellbore tractor. In a preferred embodiment, a fluid manifold 80 is in fluid communication between the one or more flow conduits and the discharge of jet pump 25. In one embodiment, one or more inlet ports 82 in manifold 80 receive the sand-ladened slurry from jet pump 25.

Figure 8:
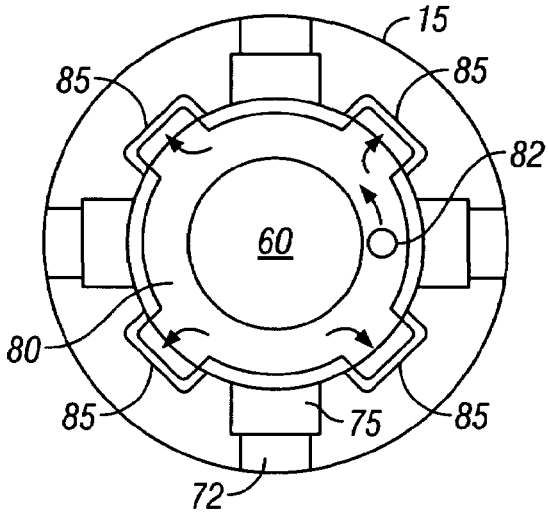
FIG. 8 is an end view of an improved, wheeled wellbore tractor having a plurality of external flow channels extending longitudinally along the external surface of the tractor body.

FIG. 8 illustrates an end view of one embodiment of a wellbore tractor having external flow channels. In the embodiment illustrated in FIG. 8, four external flow channels 85 are spaced in between the retractable wheel assemblies. Wheels 72 are attached to the tractor body on retractable arms 75. The profile of the flow channels is less than the diameter of the extended wheel assemblies so that the flow channels will not become hung up on obstacles in the wellbore. By way of example, the tractor body may have an outer diameter of 3⅛ inches and is run inside a wellbore having a diameter of 6¼ inches thus leaving approximately 1½ inches of annular space between the body of the tractor and the wellbore. Each external flow channels may have, for example, a height of ½ inches. Therefore, the tractor would have a tool diameter of 4⅛ inches when the wheels are in the retracted position. As illustrated in FIG. 8, fluid manifold 80 is in fluid communications with the discharge of the jet pump via inlet port 82 and distributes fluid to the external flow channels 85 such that the sand-ladened slurry may be pumped down the flow channels and exhausted or deposited behind the tractor. External flow channels 85 may be attached to the tractor body by any conventional means, such as bolts, set screws, straps or by welding. The number and size of flow conduits 66 or external flow channels 85 are selected to maintain an effective flow area to handle the flow rate of the jet pump without creating significant back pressure.

Figure 10:
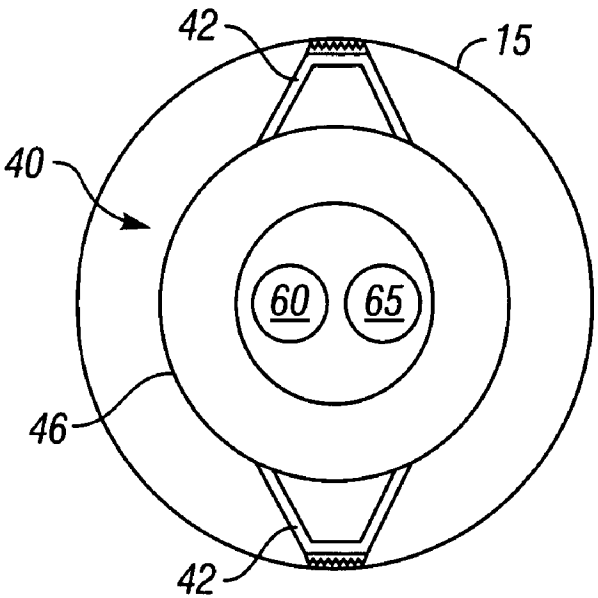
FIG. 10 is an end view of a caterpillar type tractor having a return fluid passageway arranged side-by-side with the power fluid conduit.

For caterpillar-style tractors, such as the one illustrated in FIGS. 3A–G, the return fluid passageway 65 may be arranged side-by-side with the central passageway 60 as shown in FIG. 10. Alternatively, a divider may be attached by welding or other suitable means in the central passageway to partition a portion of the passageway to create the return fluid passageway.

Figure 9:
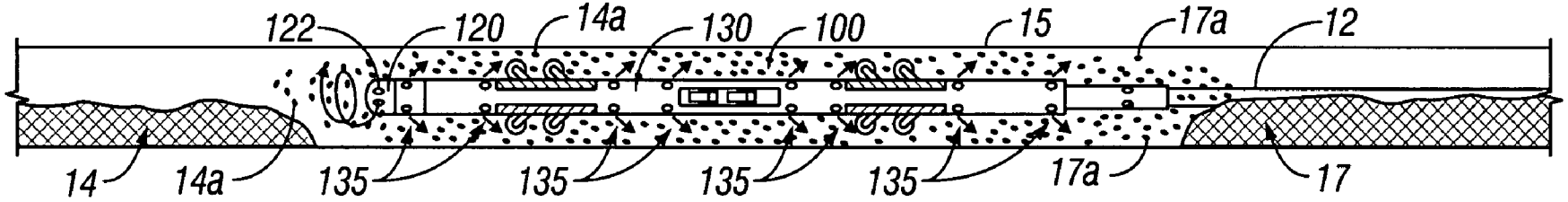
FIG. 9 illustrates an alternative coiled tubing tractor assembly being moved through a horizontal wellbore having sand beds on the low side of the wellbore.

FIG. 9 illustrates another embodiment of the invention for moving sand beds in front of the coiled tubing tractor to a location behind the tractor. The coiled tubing tractor assembly 100 comprises a forward facing jetting assembly 120 connected to a coiled tubing tractor 130. Jetting assembly 120 includes one or more forward angled jet nozzles 122. The tractor includes a means for driving the tractor and pulling coiled tubing through the wellbore. Coiled tubing tractor assembly 100 does not include a jet pump. Instead, the coiled tubing tractor includes one or more rearward facing fluidizing jet nozzles 135. The rearward facing fluidizing nozzles extend through the body of tractor 130 and are in fluid communication with the central fluid passageway extending through the tractor body. Although the wheeled tractor is illustrated in FIG. 9, it will be appreciated that the invention may be used with a caterpillar-type tractor as well.

In operation, a power fluid is pumped down the coiled tubing to the coiled tubing tractor assembly. The power fluid powers the tractor so that the means for driving the tractor is activated. A portion of the power fluid continues through the central passageway of the tractor and exits the forward facing jetting assembly to stir and break up the sand beds in front of the tractor and fluidize the sand particles. At the same time, another portion of the power fluid will exit the one or more rearward facing fluidizing jet nozzles in the tractor body, the rearward facing fluidizing nozzles being a fluid communication with the central passageway of the tractor. The rearward facing nozzles 135 maintain the sand particles 14*a* in turbulent fluid suspension and move the sand back past the trailing end of the tractor, whereafter the sand 17*a* will eventually form new sand beds 17 up the wellbore. Like the jet pump method, the rearward facing fluidizing jetting method cleans the wellbore substantially of sand in the immediate vicinity of the tractor so the tractor may be driven in a substantially sand-free section of casing or wellbore.

By way of example, using the present invention may create a clean section of casing or wellbore, for instance, extending about three feet in front of and about three feet behind the tractor. Obviously, the length of the clean section of wellbore will be a function of many factors, such as flow rate, tractor size, hole size, jet sizes, and rheological properties of the power fluid.

Using the assembly illustrated in FIG. 9 typically needs a higher fluid flow rate to suspend sand particles than an assembly having a jet pump, such as the one shown in FIG. 1. This may require running the coiled tubing tractor assembly on a bigger coiled tubing string. Thus, for example, when cleaning with a rearward facing jetting assembly flow rates of 1½ to 2 barrels per minute in a 1¾ inch to 2 inch coiled tubing may be required to adequately suspend and maintain the sand particles in suspension until they are deposited behind the tractor assembly. By way of comparison, using the coiled tubing tractor assembly with a jet pump may require a flow rate, for example, on the order of 1 barrel per minute through a 1½ or 1¾ inch coiled tubing string to adequately displace the sandbed.

Upon reaching the end of the wellbore or reaching a point where it is no longer possible to move the coiled tubing string through the sand beds behind the tractor assembly, the sand is circulated out of the wellbore. There are several ways of removing the sand behind the tractor assembly out of the wellbore. The simplest method is to rely on pure fluid velocity and flow rates to clean out the wellbore behind the tractor assembly. Typically, this method is practiced with the coiled tubing in a stationary position to keep from prematurely fatiguing the coiled tubing. Although simpler, this method may require several hole volumes to be circulated at high fluid velocity to remove the sand from the wellbore and thus tends to be more time consuming and more expensive.

In a preferred embodiment, a pump through, in-line jetting tool 35 having rearward facing jet nozzles may be inserted between the coiled tubing and the coiled tubing tractor. The preferred jetting tool is described in U.S. Pat. No. 6,607,607 (incorporated herein by reference), assigned to BJ Services Company, and available commercially as the Tornado™ tool. The Tornado™ tool uses one or more rearward facing jet nozzles that may be selectively activated to re-entrain sand particles that have settled into beds 17 into the cleanout fluid. Operationally, the power fluid is circulated down through the Tornado™ to the tractor and the forward facing jetting tool. The rearward facing nozzles of the Tornado™ are actuated by increasing the flow rate through the tool to a predetermined level. This causes an inner mandrel inside the tool to shift, thereby closing off forward flow and directing flow through the rearward facing nozzles of the tool. The rearward nozzles may be larger than the forward facing nozzles so less pressure drop occurs through the rearward facing nozzles, thus providing a surface indication that the rearward facing nozzles have been activated. By activating the rearward facing nozzles, circulating a cleanout fluid through the nozzles and controlling the pull-out-of-hole speed, the sand can be swept out of the hole with near 100% efficiency. Smaller circulation volumes are required with the Tornado™ tool. The Tornado™ tool allows an operator to move the coiled tubing and to sweep the solids out of the wellbore at lower pressures and flow rates, thereby providing a more efficient clean up process with less fatigue on the coiled tubing.

In another embodiment, larger nozzles may be included in the back of the tractor. By increasing the flow rate through the tractor, sand could be swept out of the hole while pulling the tractor out of the hole without the use of a pump through, in-line jetting tool 35.

While the apparatus, assemblies and methods of this invention have been described in terms of preferred embodiments, it will be apparent to those of skill in the art that variations may be applied to the process described herein without departing from the concept, spirit and scope of the invention. By way of example, the described apparatus and methods may also be used to remove particulate matter in flowlines. All such similar substitutes and modifications apparent to those skilled in the art are deemed to be within the spirit, scope and concept of the invention as it is set out in the following claims.

What is claimed is:

1. A wellbore tractor comprising:

a tractor body;

a central fluid passageway extending through the length of the tractor body;

a return fluid passageway, the return fluid passageway further comprises one or more flow conduits;

a fluid manifold in fluid communication with the one or more flow conduits; and a means for driving the tractor through the wellbore.

2. The wellbore tractor of claim 1, wherein the area between the surface of the central passageway and the outer surface of the tractor body define the wall of the tractor body and the one or more flow conduits extend longitudinally through at least a portion of the wall of the tractor body.

3. The wellbore tractor of claim 1, wherein the one or more flow conduits comprise one or more external flow channels extending along at least a portion of the outer surface of the tractor body.

4. The wellbore tractor of claim 2, wherein the one or more flow conduits extend substantially the length of the tractor body.

5. The wellbore tractor of claim 3, wherein the one or more external flow channels extend substantially the length of the tractor body.

6. The wellbore tractor of claim 1, wherein the return fluid passageway is arranged side-by-side with the central fluid passageway.

7. A wellbore tractor comprising:

a tractor body;

a central fluid passageway extending through the length of the tractor body;

one or more rearward facing jets extending through the tractor body and in fluid communication with the central fluid passageway; and a means for driving the tractor through the wellbore.

8. A method of moving a coiled tubing tractor through a wellbore containing sand, the method comprising the steps of:

running a coiled tubing tractor assembly on a coiled tubing into the wellbore, the tractor assembly comprising one or more forward facing jet nozzles, a jet pump and the tractor;

removing a sand bed ahead of the tractor by fluidizing the sand particles with the one or more forward facing nozzles to create a sand-ladened slurry;

pumping the sand-ladened slurry via the jet pump past the trailing end of the tractor; and driving the tractor through the portion of the wellbore that previously contained the sand bed.

9. The method of claim 8, further comprising pumping the sand-ladened slurry through one or more return flow conduits of the tractor and expelling the slurry through the trailing end of the tractor.

10. The method of claim 8, further comprising depositing sand from the sand-ladened slurry in the wellbore behind the tractor.

11. The method of claim 10, further comprising circulating the sand out the wellbore.

12. The method of claim 10, further comprising sweeping the sand out of the wellbore while pulling out of the hole with the coiled tubing tractor assembly.

13. The method of claim 12, further comprising sweeping the sand out of the wellbore with one or more rearward facing jets located between the tractor and the coiled tubing.

14. The method of claim 12, further comprising sweeping the sand out of the wellbore with one or more rearward facing jet nozzles located on the tractor.

15. A method of moving a coiled tubing tractor through a wellbore containing sand, the method comprising the steps of:

running a coiled tubing tractor assembly on a coiled tubing into the wellbore, the tractor assembly comprising one or more forward facing jet nozzles, the tractor and one or more rearward facing jet nozzles;

removing one or more sand beds ahead of the tractor by fluidizing the sand particles with the one or more forward facing nozzles;

maintaining the sand in fluid suspension with the rearward facing nozzles until the sand particles settle behind the tractor; and driving the tractor through the portion of the wellbore that previously contained the one or more sand beds.

16. The method of claim 15, further comprising circulating the sand out the wellbore.

17. The method of claim 15, further comprising sweeping the sand out of the wellbore while pulling out of the hole with the coiled tubing tractor assembly.

18. The method of claim 17, further comprising sweeping sand out of the wellbore with a jetting tool located between the tractor and the coiled tubing, the jetting tool having one or more rearward facing jet nozzles.

19. A coiled tubing tractor assembly comprising:

a forward jetting assembly operable to fluidize sand beds ahead of a coiled tubing tractor;

the coiled tubing tractor having a tractor body, a central fluid passageway and a return fluid passageway; and a jet pump connected between the forward jetting assembly and the tractor, wherein the jet pump is operable to pump the fluidized sand through the return fluid passageway to expel the fluidized sand past the trailing end of the tractor.

20. The assembly of claim 19, further comprising a rearward-jetting tool operable to circulate the sand behind the tractor out of the wellbore.

21. The assembly of claim 19, wherein the forward jetting assembly comprises one or more angled jet nozzles.

22. The assembly of claim 19, wherein the forward jetting assembly comprises a rotating jetting head.

23. The assembly of claim 19, wherein the return fluid passageway comprises one or more flow conduits.

24. The assembly of claim 23, wherein the surface of the central passageway and the outer surface of the tractor body define the wall of the tractor body and the one or more flow conduits extend longitudinally through at least a portion of the wall of the tractor body.

25. The assembly of claim 23, wherein the one or more flow conduits comprise one or more external flow channels extending along at least a portion of the outer surface of the tractor body.

26. The assembly of claim 23, further comprising a fluid manifold in fluid communication with the one or more flow conduits.

27. A coiled tubing tractor assembly comprising:

a forward jetting assembly operable to fluidize sand beds ahead of a coiled tubing tractor;

the coiled tubing tractor having a tractor body, a central fluid passageway extending through the tractor body, and one or more rearward facing nozzles extending through the tractor body and in fluid communication with the central fluid passageway, the rearward facing nozzles operable to maintain the sand in fluid suspension until the sand travels past the tractor.

28. The assembly of claim 27, further comprising a rearward-jetting tool between the tractor and a coiled tubing string.

29. A method of driving a coiled tubing tractor through a wellbore, the method comprising the steps of:

providing a coiled tubing tractor assembly on a coiled tubing in a wellbore, the tractor assembly comprising one or more forward facing jet nozzles, a jet pump and the tractor;

circulating a power fluid through the tractor and out the one or more forward facing jet nozzles to create one or more jet streams in the wellbore ahead of the tractor assembly;

pumping at least a portion of the jetted power fluid in the wellbore past the trailing end of the tractor with the jet pump; and driving the tractor through the jetted section of the wellbore.

30. The method of claim 29, comprising fluidizing particulates ahead of the tractor assembly with the one or more jet streams.

31. The method of claim 30, further comprising pumping the fluidizing particulates past the trailing end of the tractor with the jet pump.

32. The method of claim 29, further comprising pumping the portion of the jetted power fluid through one or more return flow conduits of the tractor.

33. A method of driving a coiled tubing tractor through a wellbore, the method comprising the steps of:

providing a coiled tubing tractor assembly on a coiled tubing in a wellbore, the tractor assembly comprising one or more forward facing jetting nozzles, the tractor and one or more rearward facing jetting nozzles;

circulating a portion of a power fluid through the tractor and out the one or more forward facing jetting nozzles to create one or more jet streams in the wellbore ahead of the tractor assembly;

circulating another portion of the power fluid through the one or more rearward facing jetting nozzles; and driving the tractor through the jetted section of the wellbore.

34. The method of claim 33, comprising fluidizing particulates ahead of the tractor assembly with the one or more jet streams from the forward facing jetting nozzles.

35. The method of claim 34, comprising maintaining the fluidized particulates in fluid suspension with the rearward facing jetting nozzles.

36. A method of driving a coiled tubing tractor through a flowline, the method comprising the steps of:

providing a coiled tubing tractor assembly on a coiled tubing in a flowline, the tractor assembly comprising one or more forward facing jet nozzles, a jet pump and the tractor;

circulating a power fluid through the tractor and out the one or more forward facing jet nozzles to create one or more jet streams in the flowline ahead of the tractor assembly;

pumping at least a portion of the jetted power fluid in the flowline past the trailing end of the tractor with the jet pump; and driving the tractor through the jetted section of the flowline.

37. The method of claim 36, comprising fluidizing particulates ahead of the tractor assembly with the one or more jet streams.

38. The method of claim 37, further comprising pumping the fluidizing particulates past the trailing end of the tractor with the jet pump.

39. The method of claim 36, further comprising pumping the portion of the jetted power fluid through one or more return flow conduits of the tractor.

40. A method of driving a coiled tubing tractor through a flowline, the method comprising the steps of:

providing a coiled tubing tractor assembly on a coiled tubing in a flowline, the tractor assembly comprising one or more forward facing jetting nozzles, the tractor and one or more rearward facing jetting nozzles;

circulating a portion of a power fluid through the tractor an out the one or more forward facing jetting nozzles to create one or more jet streams in the flowline ahead of the tractor assembly;

circulating another portion of the power fluid through the one or more rearward facing jetting nozzles; and driving the tractor through the jetted section of the flowline.

41. The method of claim 40, comprising fluidizing particulates ahead of the tractor assembly with the one or more jet streams from the forward facing jetting nozzles.

42. The method of claim 40, comprising maintaining the fluidized particulates in fluid suspension with the rearward facing jetting nozzles.

* * * * *

UNITED STATES PATENT AND TRADEMARK OFFICE

CERTIFICATE OF CORRECTION

PATENT NO. : 7,172,026 B2
APPLICATION NO. : 10/816287
DATED : February 6, 2007
INVENTOR(S) : John G. Misselbrook It is certified that error appears in the above-identified patent and that said Letters Patent is hereby corrected as shown below:

In column 10, line 24 of claim 40, replace “an” with --and--

Signed and Sealed this

Eighth Day of May, 2007

JON W. DUDAS
*Director of the United States Patent and Trademark Office*